United States Patent [19]

Gentry

[11] Patent Number: 4,733,439

[45] Date of Patent: Mar. 29, 1988

[54] FASTENER FOR SHOES

[76] Inventor: Keith B. Gentry, 6201 Beechfield, Apt. 307, Lansing, Mich. 48911

[21] Appl. No.: 57,616

[22] Filed: Jun. 3, 1987

[51] Int. Cl.[4] ..... A43C 9/00

[52] U.S. Cl. ..... 24/143 A; 24/117; 40/2 E

[58] Field of Search ..... 24/143 R, 143 A, 143 B, 24/140, 141, 117, 122, 118, 306, 573; 36/1, 50; 40/2 E; 160/10, 166 A, 236

[56] References Cited

U.S. PATENT DOCUMENTS

| | | | |
|---|---|---|---|
| 275,942 | 4/1883 | Porter | 24/117 R |
| 1,640,195 | 8/1927 | Kondolf | 24/143 B |
| 1,995,243 | 3/1935 | Clarke | 24/140 |
| 2,074,482 | 3/1937 | Martens | 160/236 |
| 2,095,869 | 10/1937 | Hermson | 40/2 E |
| 2,650,399 | 9/1953 | Torelli | 24/117 R |
| 2,839,804 | 6/1958 | Benoit | 24/140 |
| 2,871,537 | 2/1959 | Hickerson | 24/117 R |
| 3,701,572 | 10/1972 | Velasquez | 24/143 A |
| 4,210,983 | 7/1980 | Green | 24/143 A |
| 4,536,975 | 8/1985 | Harrell | 40/2 E |

FOREIGN PATENT DOCUMENTS

| | | | |
|---|---|---|---|
| 1187839 | 9/1959 | France | 40/2 E |

*Primary Examiner*—Victor N. Sakran
*Attorney, Agent, or Firm*—Ian C. McLeod

[57] ABSTRACT

Shoe (100) fasteners (10) which include multiple elastic strips (11 to 15) connected between spaced apart eyelets (101) in the shoe and which are provided with unitary indicia (20 or 21) on at least two of the strips are described. Preferably loops (19) are held in place in tension in the eyelets by pins (18) so that the strips remain on the shoe regardless of whether a foot is in the shoe.

15 Claims, 11 Drawing Figures

Figure 7:
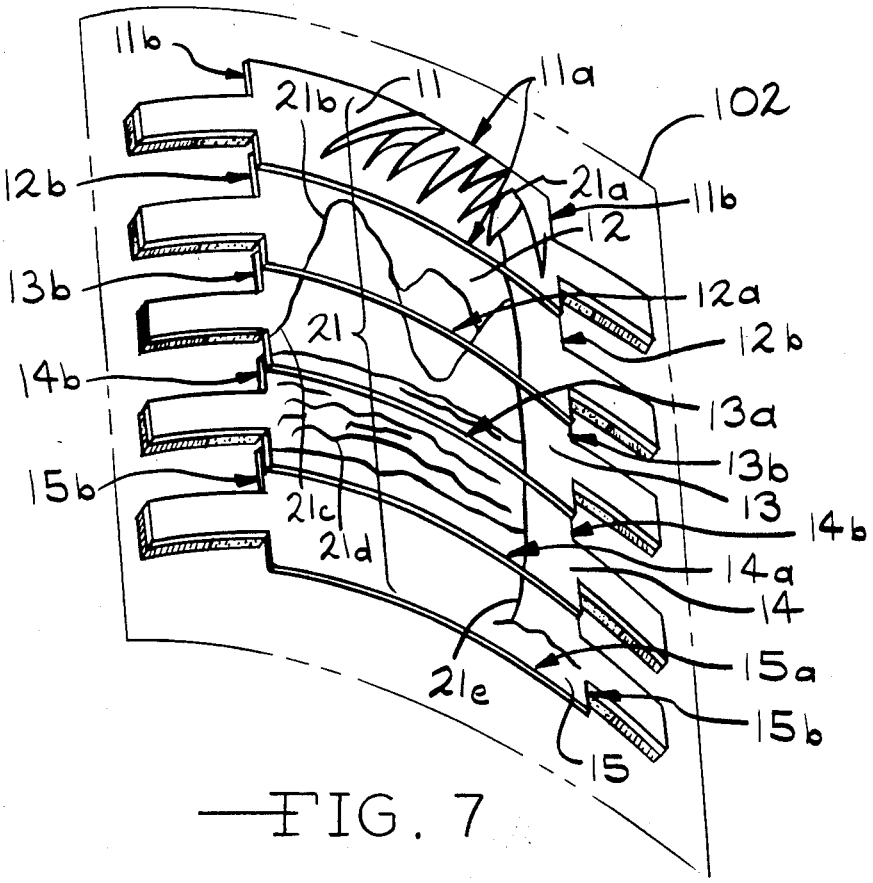

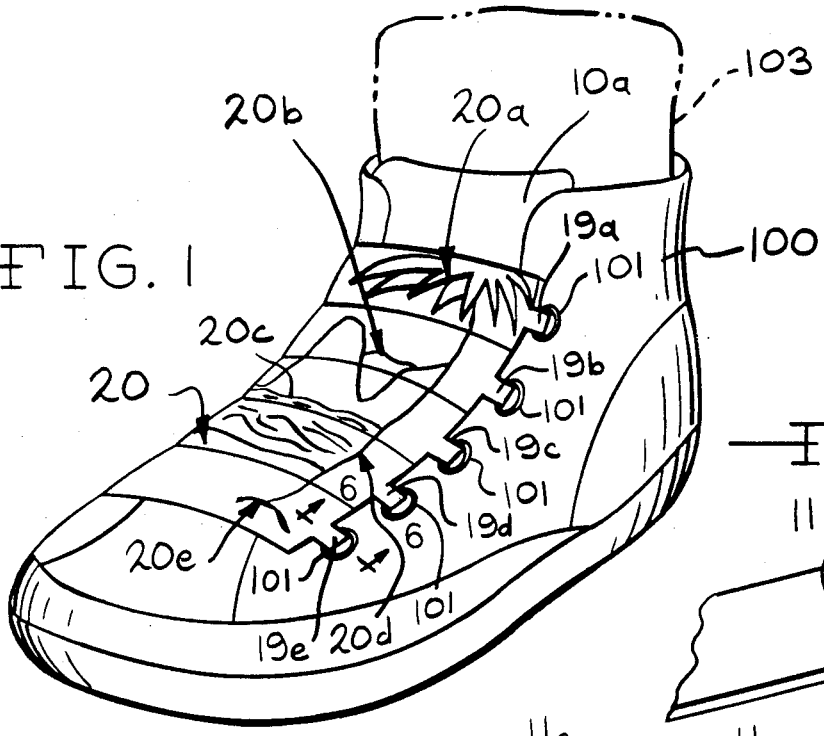
FIG. 1
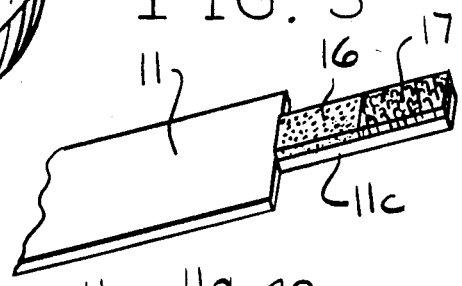
FIG. 3
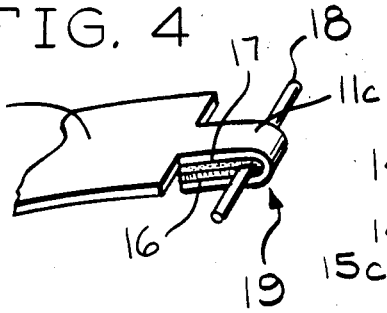
FIG. 4
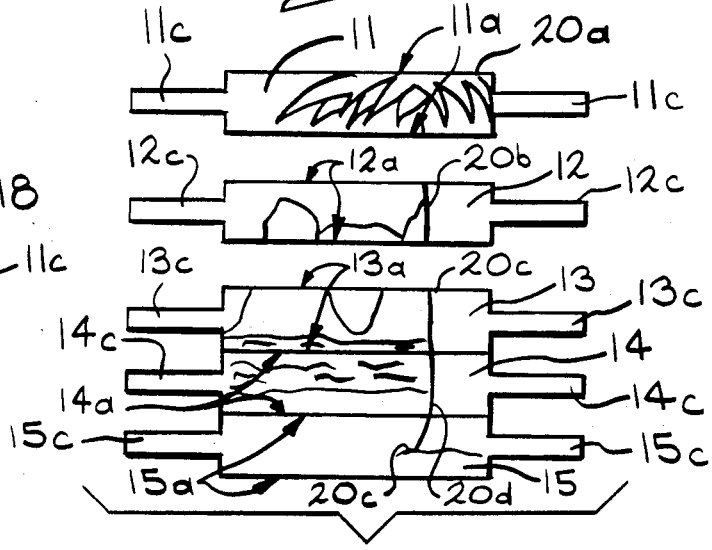
FIG. 2
FIG. 5
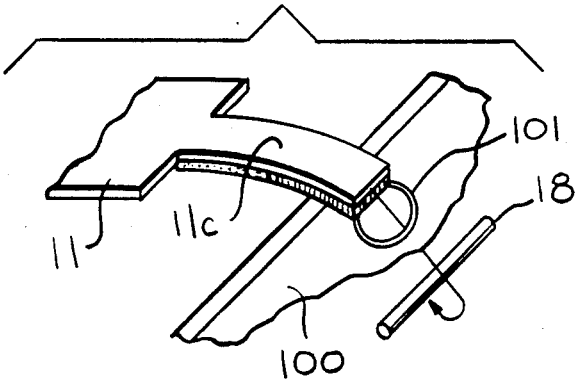
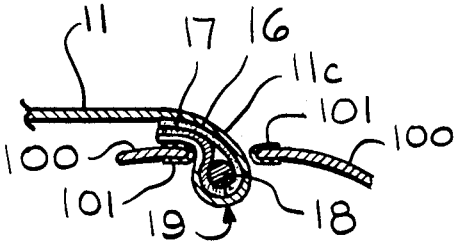
FIG. 6

FASTENER FOR SHOES

BACKGROUND OF THE INVENTION (1) Summary of the Invention

The present invention relates to a fastener combination for shoes including abutting or overlapping elastic strips each of which are connected between spaced apart eyelets of the shoe. In particular the present invention provides the strips with unitary indicia provided on at least two of the strips.

(2) Prior Art

The prior art has shown elastic laces which are stretched between spaced apart eyelets of a shoe. Illustrative of such fasteners are U.S. Pat. Nos. 4,144,621 and 4,210,983 to Green. Other related patents are U.S. Pat. Nos. 2,004,702 to Luttmann; 2,069,083 to Adamson; 2,082,537 to Butler; 2,824,351 to Webb; 3,533,172 to Jones; 3,701,572 to Velasquez; and 3,931,686 to Rathbun. None of these patents describe strips which are joined together with indicia forming a unitary design. Various holding means for the laces are described in these patents, some of which are expensive to manufacture.

OBJECTS

It is therefore an object of the present invention to provide a new shoe fastener combination. Further it is an object of the present invention to provide a shoe fastener combination which provides a unitary design in the form of advertising, pictures or the like. Further still it is an object of the present invention to provide a shoe fastener combination which is simple and economical to manufacture. These and other objects will become increasingly apparent by reference to the following description and the drawings.

IN THE DRAWINGS

FIG. 1 is a perspective view of a shoe 100 on a foot 103 (dotted lines) with multiple abutting strips 11 to 15 mounted on the shoe 100 and particularly showing indicia 20*a* to 20*e* on each strip which combine together to form a unitary design.

FIG. 2 shows the strips 11 to 15 prior to mounting on the shoe 100 and particularly showing the indicia 20*a* to 20*e* which combine together to form the design of FIG. 1.

FIG. 3 shows one of the strips 11 with fabric connectors (Velcro) 16 and 17 on extensions 11*c* to 15*c* which join together to form a loop 19 as shown in FIG. 4.

FIG. 4 shows the loop 19 in tension through an eyelet (shown in dotted lines) and held in place by a pin 18 such that the pin is held in place even when a foot is not in the shoe 100.

FIG. 5 is a perspective view of one method of mounting the pin 18 in the shoe 100.

FIG. 6 is a front cross-sectional view through an eyelet 101 showing the pin 18 mounted in loop 19.

FIG. 7 is a perspective view of the strips 11 to 15 shown in FIG. 1 overlapping to form a unitary design 21 with a display board 102 shown in broken lines.

Figure 8:
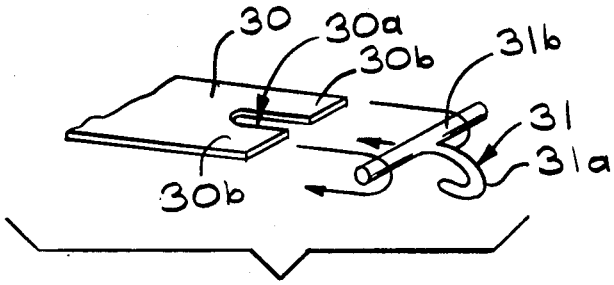

FIG. 8 is a perspective view showing means for mounting a hook 31 on a strip 30 adapted to mount through an eyelet 101.

Figure 9:
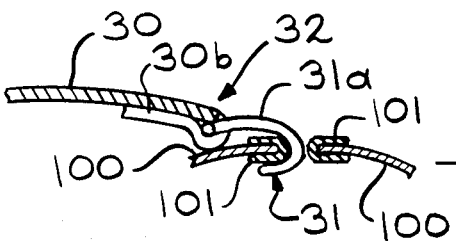

FIG. 9 is a front cross-sectional view showing the hook 31 mounted in the eyelet 101.

Figure 10:
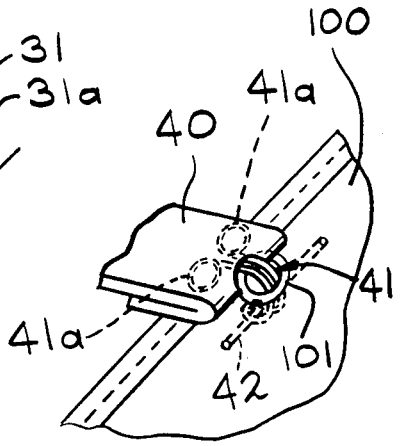

FIG. 10 is a perspective view of a wire hook 41 mounted through an eyelet 101 and held in place by pin 42 inside the shoe 100.

Figure 11:
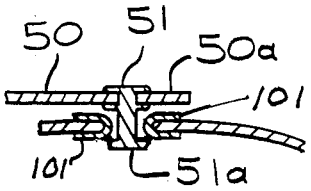

FIG. 11 shows a strap 50 of an elastic material with a rivet 51 having a head 51*a* which snaps into an eyelet 101 of a shoe.

GENERAL DESCRIPTION

The present invention relates to a shoe fastener combination which extends between spaced apart eyelets on either side of a tongue of the shoe the improvement which comprises multiple elongate flat strips of an elastic material having opposed sides which extend across the shoe between opposed ends to be positioned adjacent the eyelets, wherein the sides of the strips abut or overlap each other on the sides when on the shoe; indicia which combine together to form a unitary image across at least two of the multiple strips when a foot is in the shoe; and holding means mounted on the ends of each of the strips which engage the eyelets so that the strips are in tension when the foot is placed in the shoe. It is preferred that the holding means are loops in tension through the eyelets held in place by pins.

SPECIFIC DESCRIPTION

FIG. 1 shows a shoe 100 with a tongue 101*a*, preferably a tennis shoe, supporting a foot 103 (dotted lines) with multiple strips 11 to 15 mounted on the shoe 100 as if the foot 103 was in the shoe 100. Each of the individual strips 11, 12, 13, 14 and 15 combine together so that the sides 11*a*, 12*a*, 13*a*, 14*a* and 15*a* are abutted together as shown in FIGS. 1 and 2 or overlap as shown in FIG. 7. Each of the strips 11 to 15 has opposed ends 11*b*, 12*b*, 13*b*, 14*b* and 15*b* with integral extensions 11*c*, 12*c*, 13*c*, 14*c* and 15*c*. The extensions 11*c* to 15*c* each have fabric (Velcro) connectors 16 and 17 as shown in FIG. 3 which combine together to form a loop 19 as shown in FIG. 4 surrounding a pin 18. Any other convenient method can be used to form the loop 19 such as sewing or gluing the extensions 11*c* to 15*c* to form the loop 19*a* to 19*e* (FIG. 1).

As shown in FIGS. 5 and 6, the eyelet 101 of the shoe 100 receives the extension 11*c* (or 12*c* to 15*c*) and is wrapped around the pin 18. Alternatively the loop 19 of FIG. 4 can be formed, inserted into the eyelet 101 and then the pin 18 inserted. In either instance it is important that the loop 19 be in tension in the eyelet 101 so that even when the foot 103 is not in the shoe 100, the pins 18 are held in place against the eyelet 101. In this manner the strips 11 to 15 are held in place even though the foot 103 is out of the shoe 100 and not expanding the strips 11 to 15.

As shown in FIGS. 1, 2 and 7, the strips 11 to 15 have part of the indicia 20*a*, 20*b*, 20*c*, 20*d* and 20*e* or 21*a*, 21*b*, 21*c*, 21*d* and 21*e* imprinted on them to form a unitary design 20 or 21 across the strips 11 to 15. The indicia 20 or 21 can be sewn, printed, silk screened or applied by any other convenient method to the strips 11 to 15. Preferably the strips 11 to 15 are stretched as they would be on the shoe 100 when the indicia are applied. The indicia 20 or 21 can be in the form of pictures or advertising. For sale of the strips 11 to 15, they can be provided in a package 102 (shown in broken lines in FIG. 7).

FIGS. 8 and 9 show a more conventional hook 30 mounted on a strip 30. The strip 30 has a slot 30*a* in which the hook portion 31*a* can rotate on shaft 31*b*. The hook portion 31*a* mounts into eyelet 10*c* of shoe 100.

The tabs 30*b* can be secured around shaft 31*b* by any convenient method, such as gluing, sewing or fabric connectors (Velcro) to form the loop 32. This construction is not preferred, since the hook portion 31*a* does not as readily hold the strip 30 in place when the foot 103 is out of the shoe. However, FIGS. 8 and 9 show a type of holding means for the strip 30.

FIG. 10 shows a wire type hook 41 which is held secured by tab 40*a* on strip 40. The hook 41 is a conventional wire or eyelet dress hook which is held on tab 40 by rounded portions 41*a* of the wire hook 41. A pin 42 holds the hook 41 in place adjacent the eyelet 101. The strip 40 engages the eyelet so that the hook 41 is in tension against the pin 42. This prevents the pin 42 from being dislodged even when the foot 103 is not in the shoe. FIG. 11 shows a strip 50 of an elastic material with a rivet 51 mounted on the strip 50 at one end 50*a*. The rivet has a head 51*a* which snaps into place in an eyelet 101 of the shoe. Numerous variations will occur to those skilled in the art.

It is intended that the foregoing description be only illustrative of the present invention and that the present invention be limited only by the hereinafter appended claims.

I claim:

1. In a shoe fastener combination which extends between multiple spaced apart eyelets on either side of a tongue of the shoe the improvement which comprises:

(a) multiple elongate flat strips of an elastic material each strip having opposed sides and opposed ends of the sides wherein each of the strips extends and stretches across the shoe when a foot is in the shoe between the opposed ends so that each of the opposed ends are to be positioned adjacent one of the spaced apart eyelets, wherein the opposed sides of the strips are adjacent to or overlap each other when on the shoe;

(b) indicia which combine together to form a unitary image provided across at least two of the multiple strips when a foot is in the shoe and the strips are stretched; and (c) holding means mounted on the ends of each of the strips or securing the strips to the eyelets so that the strips are stretched and the indicia on at least two of the multiple strips provide the unitary image when the foot is placed in the shoe.

2. The fasteners of claim 1 wherein the eyelets are mounted on a display board by the holding means which stretches the strips so as to display the image on the strips in a package in the same manner as when the foot is in the shoe.

3. The fasteners of claim 1 mounted on the shoe.

4. The fasteners of claim 1 wherein the holding means are loops at each of the opposed ends of the strips which extend through each of the eyelets in the shoe and are held in place by pin means through each of the loops which engage each of the eyelets inside the shoe.

5. The fasteners of claim 4 wherein the loops are formed by extensions mounting fabric loop connectors at each of the ends of the strips which join together to form the loops and to surround the pin means and wherein the loops are in tension in the eyelet when the foot is not in the shoe.

6. The fasteners of claim 3 wherein the loops are formed by metal hooks at each of the opposed ends of the strips which extend through each of the eyelets and are held in place by the pin means and wherein the loops are in tension in the eyelet when the foot is in or out of the shoe.

7. The fasteners of claim 1 wherein the holding means are hooks at each of the opposed ends which engages the eyelets.

8. The fastener of claim 1 wherein the indicia form a picture including all of the multiple strips.

9. The fasteners of claim 1 wherein the strips overlap each other on the sides.

10. The fasteners of claim 1 wherein the strips abut each other on the sides.

11. In a shoe fastener combination which extends between multiple spaced apart eyelets on either side of a tongue of the shoe the improvement which comprises:

(a) multiple elongate flat strips of an elastic material each strip having opposed sides and opposed ends of the sides wherein each of the strips extends and stretches across the shoe when a foot is in the shoe between the opposed ends so that each of the opposed ends are to be positioned adjacent one of the spaced apart eyelets, wherein the opposed sides of the adjacent strips are adjacent to or overlap each other on the side when on the shoe;

(b) indicia which combine together to form a unitary image provided across at least two of the multiple strips when a foot is in the shoe and the strips are stretched;

(c) loops provided on the ends of the strip which go through the eyelets; and (d) holding means which pass through the loops and engage the eyelets so that the loops are in tension when the foot is in or out of the shoe.

12. The fasteners of claim 11 wherein the eyelets are mounted on a display board by the holding means which stretches the strips so as to display the image on the strips in a package in the same manner as when the foot is in the shoe.

13. The fasteners of claim 11 mounted on the shoe.

14. The fasteners of claim 11 wherein the holding means are loops at each end of the opposed ends of the strips which extend through each of the eyelets in the shoe and are held in place by a pin means through each of the loops.

15. A shoe fastener combination which extends between multiple spaced apart eyelets on either side of a tongue of the shoe the improvement which comprises:

(a) an elongate flat strip of an elastic material having opposed sides and opposed ends of the sides, wherein the strip extends and stretches across the shoe when a foot is in the shoe between the opposed ends so that each of the opposed ends are to be positioned adjacent at least one of the spaced apart eyelets;

(b) indicia which provide at least part of a unitary image when a foot is in the shoe and the strip is stretched; and (c) holding means on the ends of each of the strips for securing the strips to the eyelets so that the strips are stretched to provide at least part of a unitary image when the foot is placed in the shoe. .

* * * * *